United States Patent [19]

Barnett et al.

[11] Patent Number: 5,010,608

[45] Date of Patent: Apr. 30, 1991

[54] SUPPORT SYSTEM FOR REDUCING FORMATION OF DECUBITUS ULCERS

[75] Inventors: Richard I. Barnett, Bath; William C. Knapp, Kingston, both of Canada

[73] Assignees: Du Pont Canada Inc., Mississauga; Queen's University at Kingston, Kingston, both of Canada

[21] Appl. No.: 419,891

[22] Filed: Oct. 11, 1989

[51] Int. Cl.[5] ..... A47C 27/08

[52] U.S. Cl. ..... 5/453; 4/449; 4/455

[58] Field of Search ..... 5/445, 451, 453, 455, 5/457, 487, 449

[56] References Cited

U.S. PATENT DOCUMENTS

| | | | |
|---|---|---|---|
| 2,245,909 | 6/1941 | Enfiajian | 5/455 |
| 2,998,817 | 9/1961 | Armstrong | 5/453 |
| 3,317,934 | 5/1967 | Hinrichs | 5/451 |
| 3,462,778 | 8/1969 | Whitney | 5/455 |
| 3,670,345 | 6/1972 | Doll | 5/484 |
| 3,691,570 | 9/1972 | Gaines | 5/487 |
| 3,917,327 | 11/1975 | Plasko | 292/1 |
| 4,472,847 | 9/1984 | Gammons | 5/453 |
| 4,589,405 | 5/1986 | Hemmeter | 128/79 |
| 4,627,426 | 12/1986 | Wegener | 5/487 |

FOREIGN PATENT DOCUMENTS

| | | | |
|---|---|---|---|
| 2807038 | 8/1979 | Fed. Rep. of Germany | 5/455 |
| 2404699 | 8/1985 | Fed. Rep. of Germany | 5/449 |
| 949652 | 2/1964 | United Kingdom | 5/455 |

*Primary Examiner*—Gary L. Smith
*Assistant Examiner*—F. Saether

[57] ABSTRACT

A support system that reduces the likelihood of breakdown of human skin, and hence formation of decubitus ulcers, is disclosed. The system comprises two sheets of flexible material bonded together to provide a plurality of separate cells that are capable of being alternately and repeatedly inflated and deflated by means of a fluid contained in the cells. The flexible material is impermeable to the fluid. The cells are of a size and shape and with an intercellular spacing such that in at least one of the width and length of the system, the distance between centers of adjacent inflated cells is less than the human two-point discrimination threshold and the support system is capable of supporting a human body with bottoming out either of or between the inflated cells. In particular embodiments, the support system is in the form of a mattress. The support system may be used with persons who are confined to bed, wheelchairs or the like for periods of time or who are otherwise fully or partially immobilized, including for therapeutic reasons.

36 Claims, 8 Drawing Sheets

SUPPORT SYSTEM FOR REDUCING FORMATION OF DECUBITUS ULCERS

The present invention relates to a clinical support system and related devices for use in the reduction of the breakdown of human skin, and especially to reduce the likelihood of formation of decubitus ulcers in persons who are confined to beds, wheelchairs or the like for periods of time or who otherwise are fully or partially immobilized.

As used herein:

"support system" includes mattresses, cushions, pads and other related support devices, including support systems that may be used for therapeutic or other purposes;

"bottoming out" refers to both collapse of a cell of a clinical support system such that the top portion of the cell comes into contact with the underlying or bottom portion of the cell under the influence of a weight e.g. the weight of a person, and to contact by a person with the underlying portion of the clinical support system between cells;

"human two point discrimination threshold" is measured on a person's back, being the minimum distance at which two objects may be distinguished by touch when the objects are placed on the skin, that distance being understood in the anatomy profession and being approximately 25 mm on a person's back.

Persons may become confined to a support surface e.g. beds, wheel chairs or other devices for a large variety of reasons, for instance as a result of injury or illness or as a consequence of the requirements of a job function during employment. Elderly persons may be confined to bed or other devices for extended periods of time.

Decubitus ulcers, which are also referred to as pressure ulcers, pressure sores and bedsores, are a pervasive problem in the health care field, with high cost both in terms of individual human suffering and in the financial cost to society. The incidence of decubitus ulcers in hospitalized patients ranges from about 3% to about 17% and may increase to the 20–30% range for hospitalized elderly patients (D. Norton et al, An Investigation of Geriatric Nursing Problems in Hospital, Churchill Livingstone, Edinburgh (1962)). For neurologically impaired patients, the incidence may be in the range of 30–60% of the patients (Richardson and Mayer, Gerontol. 19 235–247 (1981); Taylor, J. Gerontol. Nurs. 6 389–391 (1980)).

Decubitus ulcers are localized cellular necroses that tend to develop when soft tissue is compressed between a bony prominence and a firm surface for prolonged periods of time. External pressure exerts its influence by occluding blood flow, leading to ischemic injury. With the interruption of blood flow and hence oxygen supply, a sequence of intracellular events occurs which proceeds to an irreversible stage if the blood flow is not restored. Ischemic injury results in cell death i.e. necrosis, and the accumulation of cell debris within the tissues.

The most crucial factors in the formation of decubitus ulcers are the intensity and duration of the pressure being applied, with the relationship between these factors generally believed to be a parabolic intensity-duration curve. If the patient remains immobile and in the same position for periods of time that are less than about two hours, the ischemia is reversible and generally no long term or irreversible damage is done to the soft tissues i.e. skin, subcutaneous tissues and muscle, over bony prominences. However, if the period of immobility exceeds about two hours, decubitus ulcers begin to form, which is sometimes referred to as the formation of Stage 1 pressure sores. It is for this reason, in particular, that it is the policy of many hospitals and institutions to position patients about every two hours. However, this practice is not totally effective. In addition, there is a trend towards the care of patients in the home, rather than in a hospital, and in such circumstances nursing care may not be available for twenty four hours/day.

Both extrinsic and intrinsic factors are considered to act to reduce tissue tolerance to pressure. Extrinsic factors that exert influence on soft tissue include shear friction, moisture and temperature. Intrinsic factors that determine the susceptibility of tissue to breakdown include sensory loss, impaired mobility, advanced age, malnutrition, vascular disease, anemia, incontinence and infection.

Among the aging-related skin changes that might predispose the elderly to the formation of decubitus ulcers are: flattened dermo-epidermal junction (Montagna and Carlisle, Journal of Investigative Dermatology 73 47–53 (1979)), reduced number of Langerhans cells (Kripke, Journal of the American Academy of Dermatology 14 149–155 (1986)), decreased dermal density which becomes relatively acellular and avascular (Montagna and Carlisle, ibid.), alterations in collagen and elastic fibres (Shuster et al, British Journal of Dermatology 93 639–643 (1975)), decreased sweat and sebaceous gland function (Foster et al, Age and Ageing 5 91–101 (1976); Plewig and Kligman, Journal of Investigative Dermatology 70 314–317 (1978)), and impaired immune response (Barrett et al, Clinical Immunology and Immunopathology 17 203–211 (1980)). Versluysen (British Medical Journal (Clin. Res.) 292 1311–1313 (1985)) reported that 90% of patients with hipfractures who were over 70 years of age, developed decubitus ulcers. Failure of a decubitus ulcer to heal has been associated with nearly a six-fold higher rate of death in the elderly (Reed, MD State Med. J. 30 45–50 (1981)). Complications of decubitus ulcers include osteomyelitis and sepsis, and the mortality rate of sepsis approaches 50% (Galpin et al, American Journal of Medicine 61 346–350 (1976); Sugerman et al, Arch. Phys. Med. Rehabil. 66 177–179 (1985); Bryan et al, Arch. Intern. Med. 143 2093–2095 (1983)). Thus, decubitus ulcers are potentially a very serious problem in the health care field.

There are a variety of systems available that are intended to reduce the formation of decubitus ulcers. Most of them function on one of two principles viz. static devices e.g. foam mattresses, air mattresses, water beds and sheepskins, which attempt to redistribute support away from bony prominences, and active devices e.g. alternating air mattresses, which function by alternately shifting support pressure. Although such devices are improvements over the use of conventional mattresses, there is a need for further improvement in effectiveness and/or in efficiency of use.

Many of the static devices have only a limited life span of use because they are not capable of being cleansed in an effective manner for re-use by the same or another patient.

A critical problem with the active devices, and some static devices, is that they may be incapable of supporting the weight of a body in regions of the bony prominences. Under such circumstances, the support system collapses under the weight of the bony prominence, which comes to rest on the mattress beneath i.e. "bottoming out". This occurs because such devices tend to be composed of one or more air-filled chambers of expandable plastic material, regardless of the configuration of the chambers. The force applied by a bony prominence over a relatively small region of the support device causes the collapse of the associated portion of the air chamber, since the remainder of the air chamber only has to undergo a minor expansion in order to equalize pressure in the chamber.

Another cause for concern is the configuration of the air chambers. Most often the chambers are drawn into inter-digitating patterns of tubular or diamond or other shaped sections or cells, such that when one section is air-filled, the adjacent sections are deflated. However, the five centimetre or greater cell sizes of typical support devices have been incapable of lifting the patient sufficiently clear of the mattress beneath the device to provide effective alternating pressure, particularly over bony prominences. While the larger cell sizes of some devices have sufficient excursion i.e. height, to overcome this problem of bottoming out (Bliss et al, British Medical Journal 1 394–397 (1967)), they have experienced other problems e.g. large areas of the body are left unsupported leading to discomfort and uneasiness experienced by the patient. Even the five centimeter cell sizes are unable to prevent small bony prominences on a body from falling between the inflated cells and resting on the mattress beneath i.e. bottoming out. While the use of higher pressures in such tubes may be used to prevent bottoming out, there would be a resultant comfort problem for the patient and effective alternating pressures would not be achievable. Another limitation to these devices relates to the cycle frequency and more particularly to the time required to inflate supporting cells and deflate adjacent cells. A prolonged period for inflation and deflation precludes a pressure relief phase i.e. an interface pressure below internal capillary pressure, of sufficient duration to allow normal blood flow and tissue recovery.

Support systems that reduce the tendency for formation of decubitus ulcers have now been found.

Accordingly, the present invention provides a clinical support system comprising: two sheets of a flexible material in planar overlying relationship and bonded to each other at selected areas so as to provide a plurality of separate cells of selected size and shape in a monolayer between said sheets; said material being sufficiently impermeable to a fluid contained in said cells so that each cell may be alternately and repeatedly inflated and deflated; said cells being of such size and shape and having such intercellular spacing so that, in at least one of the width and length of said clinical support system, the distance between centres of adjacent inflated cells is less than the human two-point discrimination threshold and said clinical support system is capable of supporting a human body without bottoming out either of or between said inflated cells.

In an embodiment of the clinical support system of the present invention, said cells are of a shape and size such that a weight of 2.5 kg and having a spherical surface with a diameter of 2.67 cm placed on the clinical support system will not cause bottoming out of the clinical support system.

The present invention also provides a support system comprising:

(a) a clinical support system comprising two sheets of a flexible material in planar overlying relationship and bonded to each other at selected areas so as to provide a plurality of separate cells of selected size and shape in a monolayer between said sheets; said material being sufficiently impermeable to a fluid contained in said cells so that each cell may be alternately and repeatedly inflated and deflated; said cells being of such size and shape and having such intercellular spacing so that, in at least one of the width and length of said clinical support system, the distance between centres of adjacent inflated cells is less than the human two-point discrimination threshold and said clinical support system is capable of supporting a human body without bottoming out either of or between said inflated cells; and (b) means to inflate and deflate the cells.

In a preferred embodiment of the support system of the present invention, said cells are of a shape and size such that a weight of 2.5 kg and having a spherical surface with a diameter of 2.67 cm placed on the clinical support system will not cause bottoming out of the clinical support system.

In another embodiment of the support system, the means to inflate the cells is controlled so that when one cell is inflated, adjacent cells are deflated.

In further embodiments of the support system, the cells are capable of being inflated and deflated independently.

In still further embodiments of the support system, the means to inflate the cells is a compressor or a liquid that is capable of being vaporized to inflate the cells, especially vaporized by use of electrical heating elements or thermoelectric means.

In yet another embodiment of the support system, each cell is of a geometry that precludes complete collapse of the cell when deflated.

In addition, the present invention provides a support system comprising, in sequence, (a) a clinical support system comprising two sheets of a flexible material in planar overlying relationship and bonded to each other at selected areas so as to provide a plurality of separate cells of selected size and shape in a monolayer between said sheets; said material being sufficiently impermeable to a fluid contained in said cells so that each cell may be alternately and repeatedly inflated and deflated;

said cells being of such size and shape and having such intercellular spacing so that, in at least one of the width and length of said clinical support system, the distance between centres of adjacent inflated cells is less than the human two-point discrimination threshold and said clinical support system is capable of supporting a human body without bottoming out either of or between said inflated cells; (b) means to inflate and deflate the cells; (c) a layer of cushioning material; and (d) a layer of material having a high coefficient of friction.

In a preferred embodiment of the support system of the present invention, said cells are of a shape and size such that a weight of 2.5 kg and having a spherical surface with a diameter of 2.67 cm placed on the clinical support system will not cause bottoming out of the clinical support system.

In another embodiment of the support system, a fabric layer, especially a removable fabric layer, is located above the layer of flexible material, said fabric layer being between a moisture absorption layer and the layer of flexible material. The moisture absorption layer is preferably a microporous film layer, preferably a disposable layer.

The present invention additionally provides a cell that is capable of being alternately inflated and deflated, said cell being formed of flexible impermeable thermoplastic material and containing an inert liquid having a boiling point in the range of 0°-50° C., said cell additionally having means to heat and/or cool the liquid.

In a preferred embodiment of the cell of the invention, the liquid is one or more fluorocarbons, or one or more liquids of the type being developed to replace flurocarbons for environmental reasons, especially such fluorocarbons and liquids having a boiling point in the range of 10°-40° C., especially 20°-34° C.

While the present invention is particularly described herein with reference to clinical support systems and mattress support systems, it is to be understood that especially in some end uses, the systems may not be in a form that would commonly be referred to as clinical supports or mattresses, but rather in the form of seating or other supports, as discussed below.

The present invention will be described with particular reference to the drawings in which.

Figure 1:
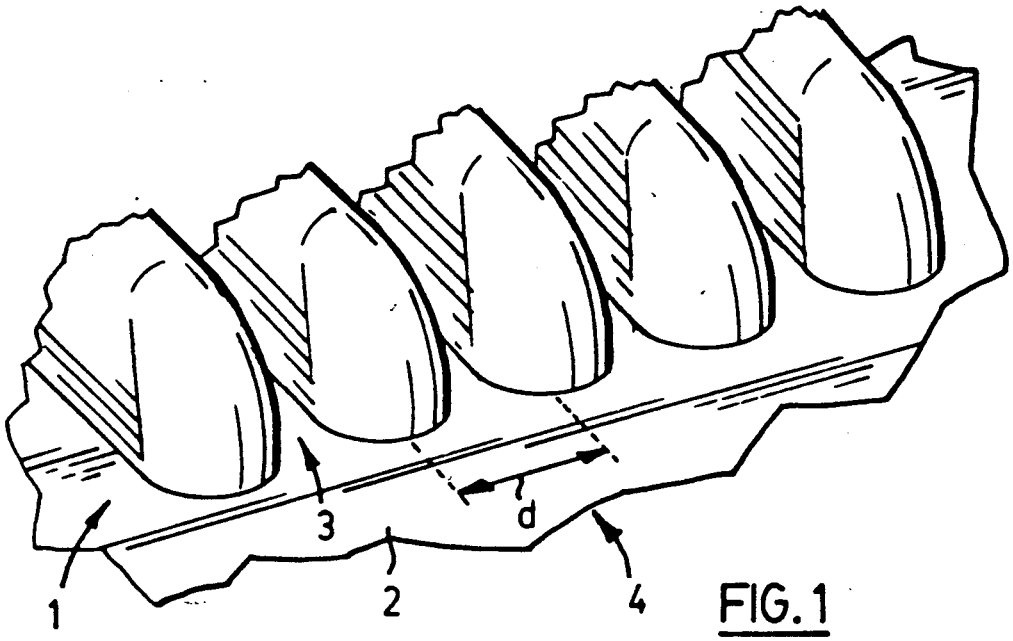
FIG. 1 is a schematic representation of part of a single row of cells of a clinical support system, all of which are shown in an inflated state.

In FIG. 1, a single row of cells 1 is shown on a substrate 2, substrate 2 being a layer of flexible material. Cells 1 are separated by spaces 3 that are substantially smaller than the distance, d, between the centres of the cells, as indicated by 4.

Figure 4:
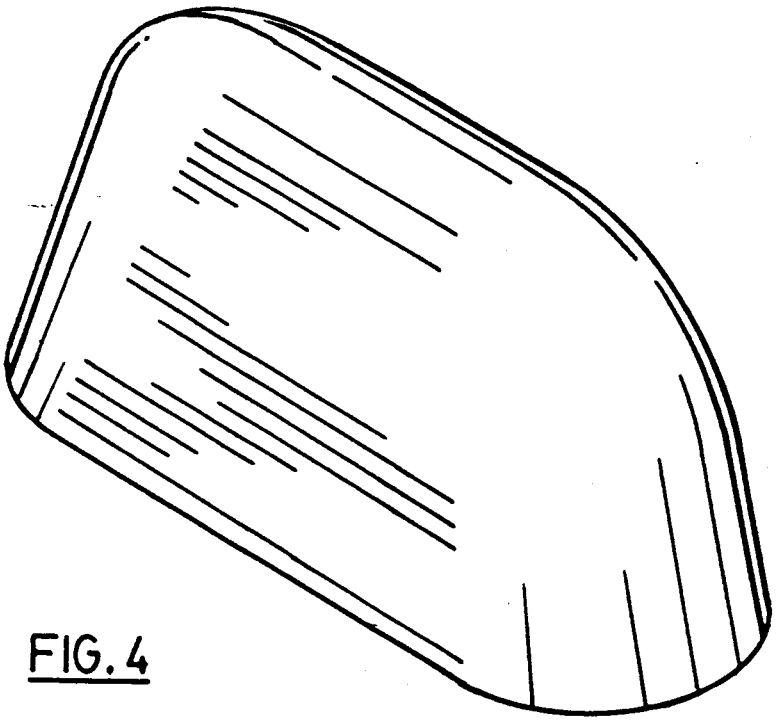
FIG. 4 is a computer simulated drawing of a cell.

The cells 1 are shown as being elongated, but it is to be understood that the cells may be of any convenient shape; nonetheless the cells should be of a size and shape that precludes "bottoming out" i.e. precludes collapse of the cell such that the top portion of the cell comes into contact with the bottom portion of the cell under the influence of a weight e.g. the weight of a patient. An example of a cell is shown as a computer simulated drawing in FIG. 4. In use, the cells 1 would be associated with means to inflate and deflate the cells in a controlled manner; such means are not shown.

Figure 2:
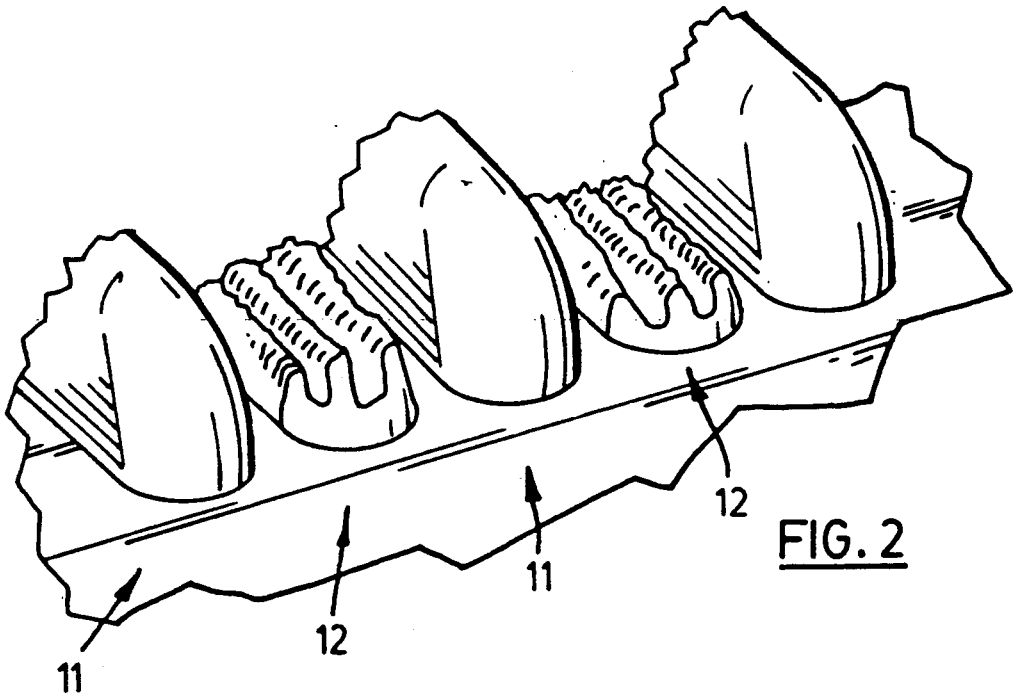
FIG. 2 is a schematic representation of the cells of FIG. 1, some of which are in a deflated state.

The cells 1 of FIG. 1 are capable of being inflated and deflated, as is shown in FIG. 2. In the embodiment shown, inflated cells 11 are separated by a deflated cell 12. The distance between the centres of the inflated cells is less than the human two point discrimination threshold, and thus a person lying on the cells is unable to distinguish by touch that alternate cells are inflated and deflated. Moreover, the patient is generally unable to sense deflation of cells 11 and inflation of cells 12.

Figure 3:
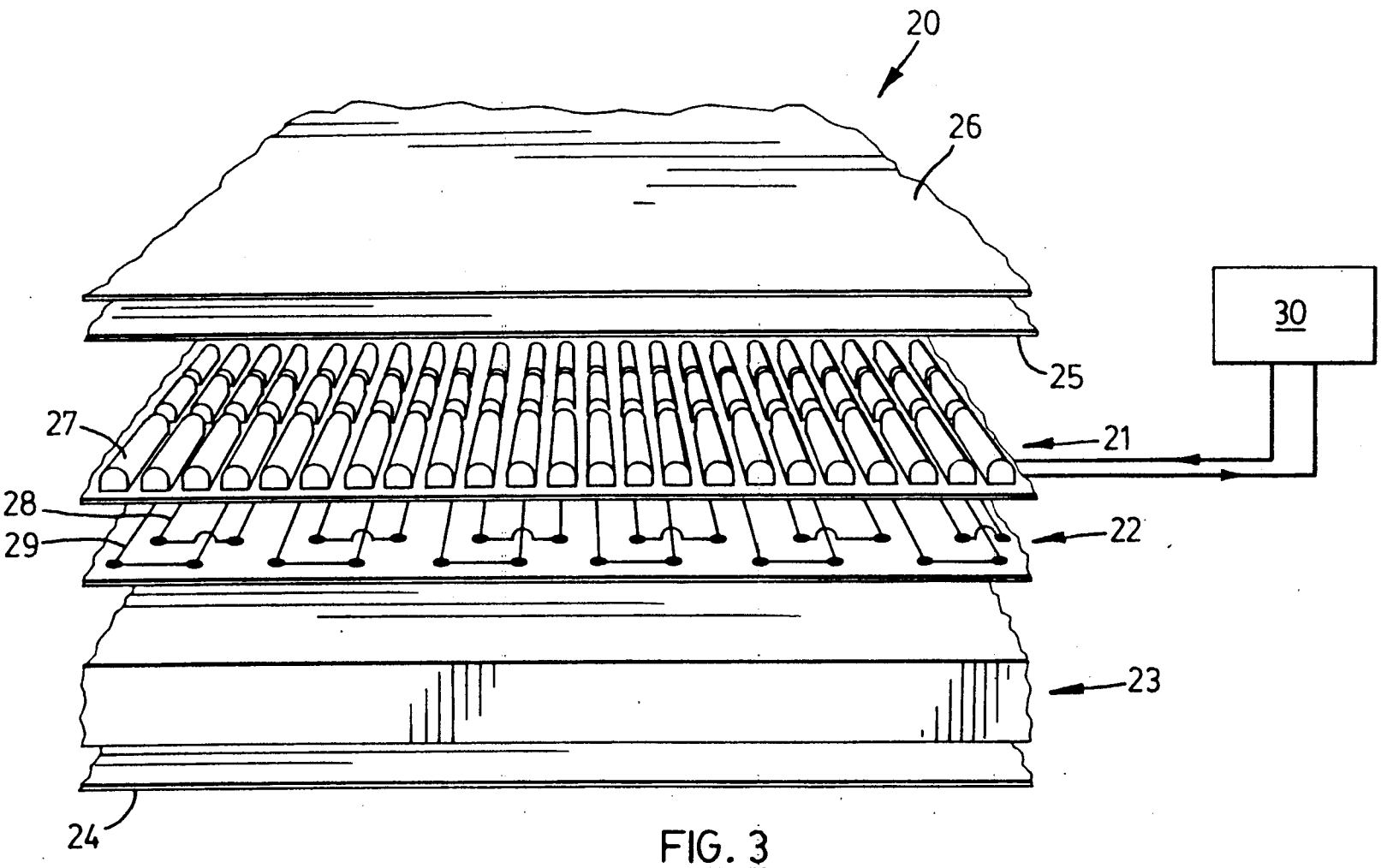
FIG. 3 is a schematic representation of an embodiment of a portion of a support system of the present invention.

In FIG. 3, a mattress system, shown generally as 20, is comprised of a closed cell layer 21 on top of a heating element layer 22, a fibre layer 23 and a high friction layer 24. On top of the closed cell layer 21 are a fabric layer 25 and an outer microporous layer 26. The closed cell layer 21 has a plurality of cells 27 which may be of the type shown in FIG. 1. The cells 27 are shown as being elongated and being aligned in both the axial direction of the cells and in the transverse direction. However, the cells could be of alternate shapes and/or be in a more random pattern.

The cells are referred to herein as being "separate cells"; it is to be understood however that even though the cells have the physical appearance of being separate cells, any one cell may be interconnected with one or more other cells for purposes of inflation and deflation of the cells.

Cells 27 are capable of being inflated and deflated. A variety of means may be used to inflate and deflate the cells. For example, the cells may be attached by means 30 of tubing to a system that will alternately supply a compressed gas e.g. compressed air, at a pressure that is sufficient to inflate cells 27 when in use, and subsequently cool or apply a vacuum to cells 27 to the extent necessary to deflate cells 27. The amount of vacuum applied may be small i.e. just sufficient to deflate the cells 27 to the extent that cells 27 no longer would support a patient on the mattress system 20. Compressors to supply the compressed air tend to be noisy and, alternatively, the supply of compressed gas could be from a source that is remote from the area of use of the mattress system e.g. from a compressor or other source of compressed gas at a remote location. Alternatively, the alternating pressure in the cells could be applied by hydraulic means on a liquid in the cell. Examples of such liquids include water and silicone oils.

A preferred method of inflating and deflating the cells 27 is to incorporate a liquid into the cells. In use of such a liquid, the liquid is heated, especially by thermoelectric means, to cause vapour to form and thereby inflate the cells 27; such heating may increase the temperature of the liquid above its boiling point but it may not be necessary to do so, provided that sufficient pressure is generated to inflate the cells 27. On cooling, the pressure in cells 27 decreases, and the cells deflate. The liquid must be selected so that sufficient vapour may be generated to cause the cells to inflate while at the same time remaining at a desired or preselected temperature. In addition, the liquid may have to be selected for a particular end-use location. For instance, in some locations the ambient temperature around the patient may be as low as about 18° C. whereas in other locations the ambient temperature may reach as high as about 40° C.

The liquid placed in the cells 27 is preferably inert, non-toxic and non-flammable, and not of concern to health authorities with respect to both the patients and persons e.g. doctors and nurses, who tend the patients. Moreover, the cells 27 need to be constructed from a material that has adequate barrier properties to the liquid, so that a supply of liquid may be retained in the cells for at least the anticipated period of use of the mattress system; such material is referred to herein as being impermeable. It is to be understood that the anticipated periods of use of a clinical support system could be six months or as long as two years, or longer. As discussed herein, the material may be a multilayered structure, including a coated structure, in order to obtain an acceptable level of impermeability.

Examples of liquids incorporated into cells include fluorocarbons, especially mixtures of chlorofluorocarbons that exhibit changes of vapour pressure over the temperature range used in inflation and deflation of the cells 27, and fluids of the type being developed to replace chlorofluorocarbons for environmental reasons e.g. hydrochlorofluorocarbons. Fluorocarbons and hydrochlorofluorocarbons are available from Du Pont Canada Inc. under the trademark Freon, examples of which are sold under the trade designations 114, 113, 22, 11, 123 and 141B.

The boiling point of the liquid should be in the range of 0°-50° C., preferably 10°-40° C. Liquids with the lower boiling points of that range could be used for cooling purposes e.g. of limbs or other parts of the body. In certain embodiments, the liquid has a boiling point in a comfortable range for a patient but below the normal human perspiration threshold, especially in the range of 20°-34° C.

Cells 27 shown in FIG. 3 are of a type that would contain a liquid. While the liquid could be heated solely by body-heat of a patient, it is preferred that electrical or especially thermoelectric means be provided to heat and cool the liquid. In FIG. 3, heating and cooling layer (thermoelectric layer) 22 located underneath closed cell layer 21 has heating and cooling means 28 and 29 that may be used to vaporize or condense the liquid. While reference is made herein to a heating and cooling layer, it is to be understood that in some embodiments the layer may be singularly a heating or cooling layer.

Heating and cooling means 28 and 29 are separate electrical circuits and are associated with adjacent cells 27, heating and cooling means 28 being used to heat and cool one cell and heating and cooling means 29 being used to heat and cool the adjacent cell. One of heating and cooling means 28 and 29 would normally be associated with each cell so that the inflating and deflating of the cell may be readily controlled. Only two heating and cooling means 28 and 29 might be used to control the entire mattress system or a variety of heating and coolng means could be used to control different parts of the mattress system in a different manner, for example using a microprocessor. It is preferred that the heating and cooling means operate on a low non-hazardous voltage i.e. a voltage substantially lower than that normally used for heating and cooling appliances.

As noted above, the flexible material must be sufficiently impermeable to permit use of the clinical support system for the anticipated periods of use. The nature of the flexible material to meet such impermeability requirements will depend, in particular, on the fluid contained in the cells of the clinical support system. For instance, flexible materials suitable for use with an inert gaseous fluid e.g. a hydrochlorofluorocarbon, may not be suitable for use if water is used as the fluid, and vice versa, as will be understood by those skilled in the art. The flexible material is preferably a polymeric material and in particular will be a laminated, heat bonded or coated polymeric material. In embodiments, the flexible material is a thermoplastic polymer that has been laminated or coated with a polymeric material that exhibits barrier properties to the liquid to be contained in the cells of the clinical support system. In one embodiment, the polymeric material is a linear low density polyethylene that has been coated with or laminated to polyvinylidene chloride (PVDC). Such a flexible material exhibits both barrier properties and flexibility and toughness properties, which are important with respect to the useful life of the clinical support system. In other embodiments, the flexible material may be polyethylene, polypropylene, polyvinyl chloride, polyvinylidene chloride, polyester, polyamide, chlorosulphonated polyethylene, vinylidene fluoride/hexafluoropropylene copolymers, polyurethane, ethylene/propylene/diene terpolymers, copolyetherester polymers, silicon rubber, butyl rubber and natural rubber, coated if necessary to obtain the required barrier properties.

The closed cell layer 21 and the thermoelectric layer 22 are shown in FIG. 3 as being located on a layer of fibre 23. Layer 23 is intended to provide cushioning to and good pressure distribution on the mattress system and thereby provide greater comfort to the patient. Layer 23 may be formed from a wide variety of fibres or foam materials, including synthetic fibres e.g. polyamide, polyester and/or polypropylene, natural fibres e.g. cotton, cellulosic or wool fibres including sheep skins and the like. In most instances, the fibre layer will be formed from synthetic fibre that has been sufficiently bulked to provide cushioning effects. An example of a preferred fibre is Quallofil ® polyester fibre that is used in the manufacture of pillows. In another embodiment, layer 23 may be an air mattress.

In FIG. 3, the fibre layer 23 is shown as being located on friction layer 24. The friction layer is provided for stability and safety of the patient, especially to prevent the mattress system from sliding off the bed or other structure on which it may be used. A variety of friction layer materials are known, including foamed thermoplastic polymers e.g. polystyrene, woven textile structures, Velcro ® materials and the like.

The mattress system shown in FIG. 3 has two layers superimposed on the closed cell layer. The layer shown immediately adjacent to the closed cell layer is a fabric layer, 25, which is primarily intended as a cover sheet or a sheet enclosing the mattress system of the invention, to retain the integrity of the mattress system and for aesthetic reasons, as well as for reasons of cleanliness and sterility to prevent infections. The outer layer shown is a microporous layer, 26, which is primarily intended for comfort of the patient. In particular, the microporous layer 26 permits perspiration or other moisture associated with the patient to be removed from the location of the patient, and improve the comfort of the patient. The microporous layer is intended to be a disposable layer. The fabric layer 25 and microporous layer 26 must be of a thickness and formed from materials such that the beneficial effects of the operation of the closed cell layer 22 are not negated. In an alternate embodiment, the outer layer could be a non-stick layer, especially such a layer that would be used with burn patients or in some therapeutic end-uses.

In operation of the mattress system of FIG. 3, a patient is placed on the mattress system, in contact with the microporous layer, or a sheet or similar layer over the microporous layer. It is preferred that the mattress system be constructed such that the cells are aligned obliquely to the axis of the patient body, and in embodiments aligned transversely to the body. The cells of the closed cell layer are then alternately inflated and deflated e.g. by applying heat using the heating element layer, and then allowing the liquid to cool or actively cooling the liquid.

The cycle of inflation and deflation may be varied, from one minute to in excess of one hour. The cycle should however be more frequent than once every two hours. Different cycles could be used for different areas of the body e.g. those areas where the body exerts greater pressure could be on a shorter cycle than areas where less pressure is exerted, or different cycles could be used for therapeutic or other reasons; it is to be expected that there will be different optimal cycle times depending on the intended use of a mattress system or clinical support system.

Reference is made herein to the cycle time for inflation and deflation of the cells. That cycle time actually includes the period of time required for transfer of fluid out of or into a cell in order to actually effect the deflation and inflation of the cell, or for condensation or vapourization of fluid wholly contained within a cell, as well as the period of time during which the cell is inflated or deflated. Such a period for transfer of fluid is finite and may be minutes in length. It is to be understood that the beneficial effects of deflation of a cell, especially restoration of normal microcirculation in the layers of the skin adjacent the deflated cell, are primarily limited to the period of time when the cell is not supporting a patient, which may be significantly shorter than the cycle time. The period of time for transfer of fluid in relation to the cycle time becomes more important at short cycle times, and may need to be considered in the operation of systems of the invention.

The inflation and deflation of cells is generally described herein in the sense that as one cell is inflated, an adjacent cell is deflated. It is to be understood that such inflation and deflation may occur simultaneously or in sequence, the latter involving inflation of a cell followed by deflation of an adjacent cell. In addition, the inflation and deflation may be carried out in the manner of a wave passing across the clinical support system, including according to a peristaltic cycle; in some instances a patient may have a sensation of such wave or peristaltic action but the action may have e.g. beneficial therapeutic effects and could be used for that or other reasons. In embodiments of the invention, a cell that is inflated would be surrounded by cells that are deflated, and vice versa, or a row of cells may be inflated and the immediately adjacent row of cells deflated, or other configurations of inflated and deflated cells may be used provided that the arrangement of inflated and deflated cells is capable of supporting a patient, as described herein.

The mattress system of the present invention provides alternating support for a patient in a manner that the patient has little or no sensation of the alternating support being provided by the mattress system i.e. parts of the patients body are alternately being supported and not supported with the patient having little or no sensation of movement in the bed on which they are lying. Any such sensation could be very disconcerting to the patient. However, the spacing, in at least one direction, of the inflated cells at distances that are less than the human two point discrimination threshold substantially eliminates or overcomes any sensation and permits the mattress system to perform its intended function. In addition, the pressure exerted on the patient's body juxtaposed to a deflated cell is less than the human internal capillary threshold e.g. 20–32 mm Hg; if this were not so, blood circulation to the particular area of the patients skin over the deflated cells would not occur and decubitus ulcers would result. The internal capillary pressure will vary from patient to patient and probably from one area of a patient to another. Capillary pressure threshold e.g. the surface pressure above which capillaries can be expected to collapse, is about 20–32 mm Hg, depending on the patient and the area of the patient in contact with the mattress system. Thus, in embodiments, it is important that the pressure exerted on the patient by a deflated cell be less than about 20 mm Hg; the more generic requirement is that the pressure exerted over the deflated cell be less than the capillary pressure threshold.

As noted above, the clinical support system is capable of supporting a human body without bottoming out either of or between the inflated cells. In an embodiment, the human body is simulated by a spherical surface. In particular, the following procedure may be used to determine whether a clinical support system is capable of supporting a human body without bottoming out: the procedure uses a jig having a head with a spherical surface having a diameter of 2.67 cm, the head having an actual diameter of 7.5 cm. The jig also has a rod axially attached to the head on the side opposite the spherical surface, the rod being adapted to receive weights. In the test procedure, the jig is placed on a surface of cells such that the jig is centrally located over a deflated cell and supported by two adjacent inflated cells. Weights having an axial hole are then added to the jig, using the rod, until the surface of the jig contacts the bottom surface of the deflated cell; at such time, the total weight of the jig should be at least 2.5 kg. Under such circumstances, the cells of the clinical support system would be of a shape and size such that a weight of 2.5 kg and having a spherical surface with a diameter of 2.67 cm placed on the clinical support system would not cause bottoming out of the clinical support system.

Figure 9A:
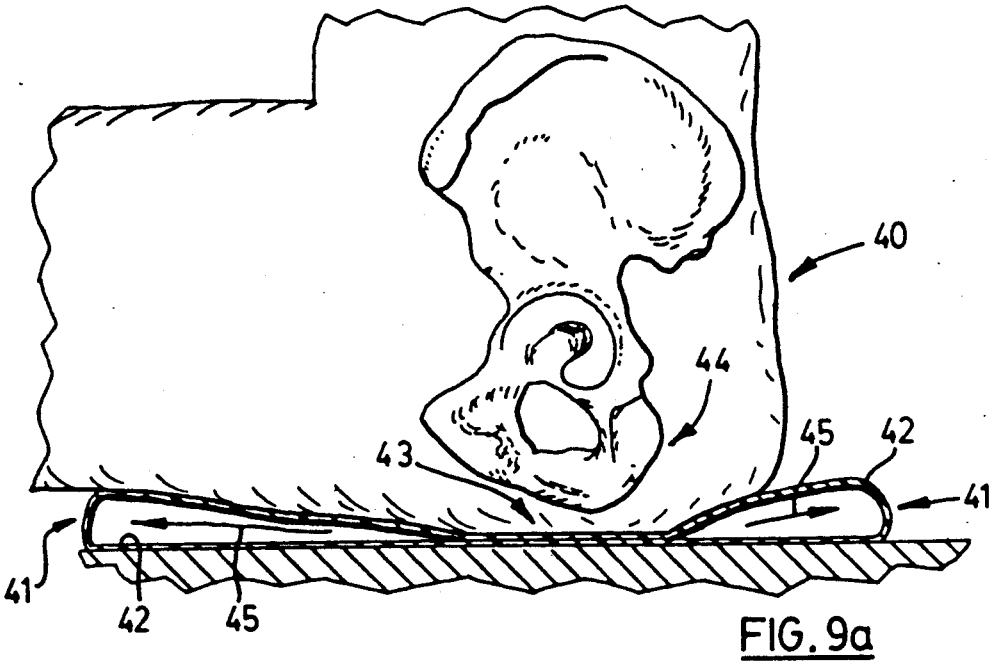
FIG. 9A and 9B are schematic sectional representations of the use of support systems having long inflated tubular cells and of support systems of the invention.

In FIG. 9A, a portion of a human torso, generally indicated by 40, is shown on a mattress or cushion system 41 having large inflatable cells 42, only one of which is shown in cross-section. The inflatable cell 42 is shown as having bottomed out at area 43, which is the region of the cell directly under the ischium 44 of the torso 45, with the gas in the inflated cell 42 being shown as having been forced away from the area 43 at which the cell has bottomed out, in the direction of the arrows 45.

Figure 9B:
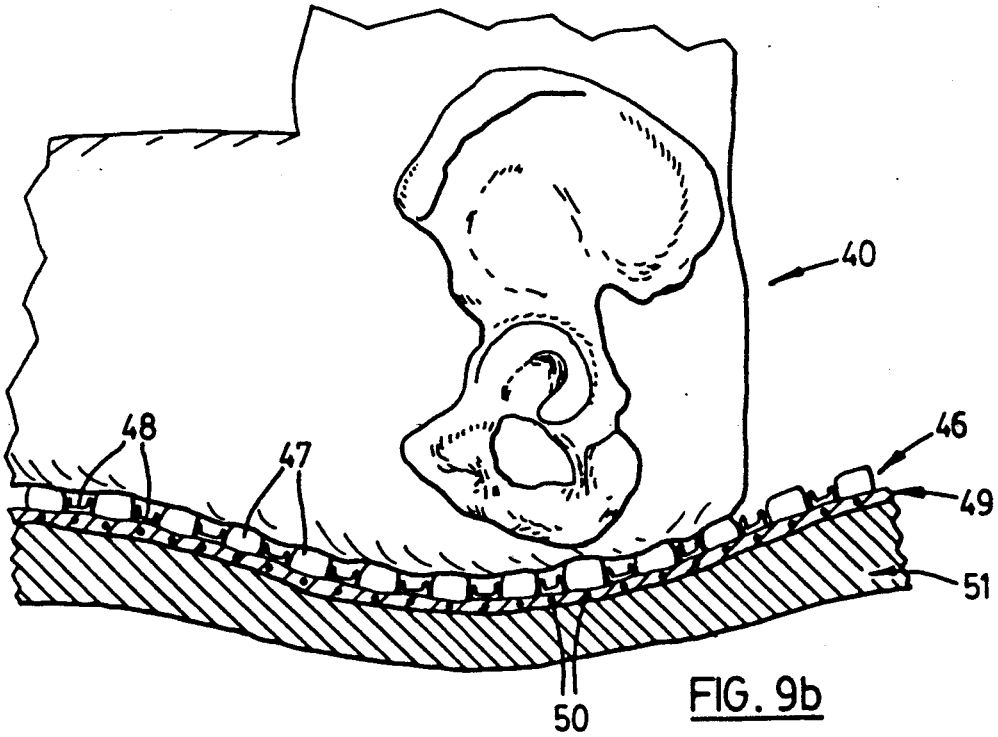

In contrast, in FIG. 9B the torso 40 is shown on a mattress system of the present invention. The mattress system is comprised of a monocellular layer 46 of cells, which are shown as being alternately inflated cells 47 and deflated cells 48. The layer of cells is attached to a flexible thermoelectric layer 49. Flexible thermoelectric layer 49 has located therein a series of heating and cooling circuits 50, each circuit 50 being located under either an inflated cell 47 or a deflated cell 48; in the embodiment shown, the heating and cooling circuits 50 under an inflated cell 47 are heating the gas 52 in the cell whereas the heating and cooling circuits 50 under a deflated cell 48 are cooling the vapour in the cell. The flexible layer 49 is shown as being located on a fibre layer 51. As is illustrated in FIG. 9B, the torso is resting on the inflated cells 47 and is not bottoming out and touching the surface of the deflated cells 48. Thus, the torso located above the deflated cells 48 has no pressure exerted on it. Activation of the heating circuits below the deflated cells 48 and activation of the cooling circuits underneath the inflated cells 47 will cause a reversal, such that the portion of the torso now shown as in contact with the inflated cells will become out of contact with the cells, and vice versa.

The mattress systems of the present invention function below both the capillary pressure threshold and the two point discrimination threshold, thereby providing the patient with the benefits of enhanced circulation of blood and a reduced tendency for formation of decubitus ulcers and at the same time provide the patient with comfort. The mattress system is easy to use, especially when a liquid capable of under going a phase change is used to provide inflation and deflation of the cells, may be readily cleaned and may be operated in a quiet manner. In embodiments, the mattress system could be operated by a microprocessor and be portable i.e. it is adaptable to portable use e.g. on wheelchairs and other portable systems, including for limbs and other parts of the body, which offers the patient the possibility of being mobile. In addition, the liquid in the cells could be cooled, to permit cooling all or part of a person's body e.g. as a cooling wrap for use in surgery or for therapeutic reasons.

While the support system of the invention have been generally described herein with reference to medical uses i.e. as mattress systems, it is to be understood that the support systems may be used in a variety of forms and for a wide variety of end uses; in many such end uses, the systems would be more commonly referred to by other names, including support systems, seats, chairs and the like. For example, systems described herein may be used in the health care, transportation and recreation businesses, examples of which include aircraft, automobile, office, home, truck and other seating.

The present invention is illustrated by the following examples:

EXAMPLE I

Holes of circular cross-section and differing in diameter were cut in a series of metal plates of different thicknesses. The diameters of the holes were as follows: 31.5 mm, 39.0 mm, 45.0 mm and 51.3 mm. The plates were of thicknesses of 4.2 mm, 5.4 mm, 6.6 mm and 7.8 mm.

The ischial prominence of a human was placed, in turn, over each of the holes; the human was a healthy male aged 46, height 173 cm, weighing approximately 84 kg and of average build. A pressure sensing device was placed in or on the opposite side of the hole, such that the desired excursion was obtained. The sensing device was on a wooden surface so that the pressure, if any, exerted by the human on the device i.e. at the plane of the opposite side of the hole, could be measured.

Figure 5:
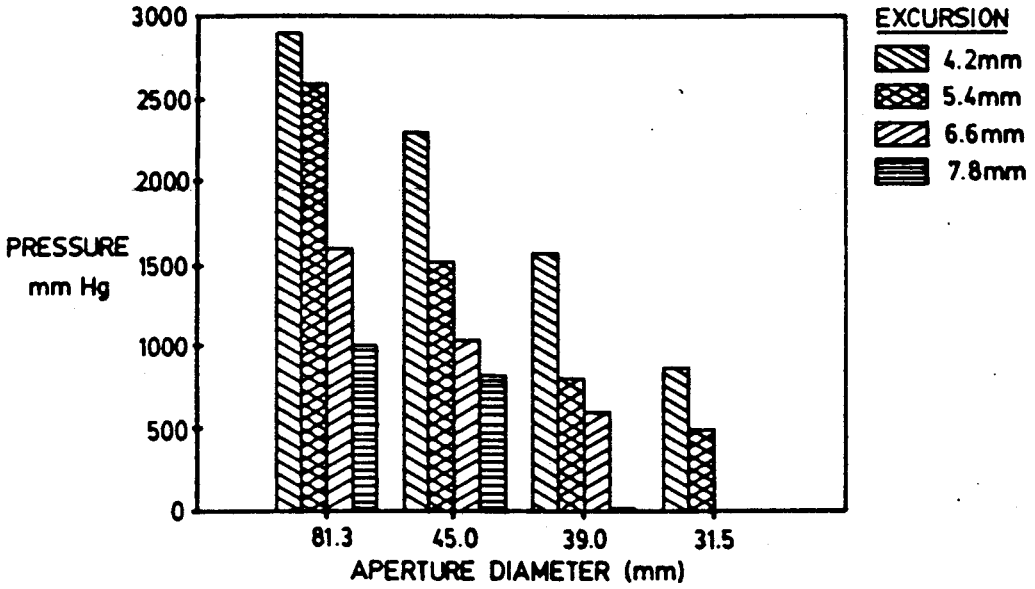
FIG. 5 is a histogram of data obtained in Example I.

The results obtained are shown in FIG. 5. In only three instances did the ischial prominence of the human fail to exert pressure i.e. to bottom out viz. the 31.5 mm hole with excursions (as measured by the distance from the surface of the plate to the pressure sensing device located in the hole) of 6.6 and 7.8 mm and the 39.0 mm hole with an excursion of 7.8 mm. Thus, for such combinations of hole diameter and excursion, bottoming out did not occur. Cells of such dimensions and of smaller diameter would not result in bottoming out for the ischial prominence of the human subject used in this example.

In a series of related tests, cell dimensions that would support a human body in a variety of positions were determined e.g. ischium in the sitting position, greater trochanter lying in the side position, and the sacrum and scapula in the supine position.

Such tests give guidance as to the cell dimensions required to prevent bottoming out in the clinical support systems of the present invention. The results obtained differ with the position of the human body.

EXAMPLE II

Figure 6:
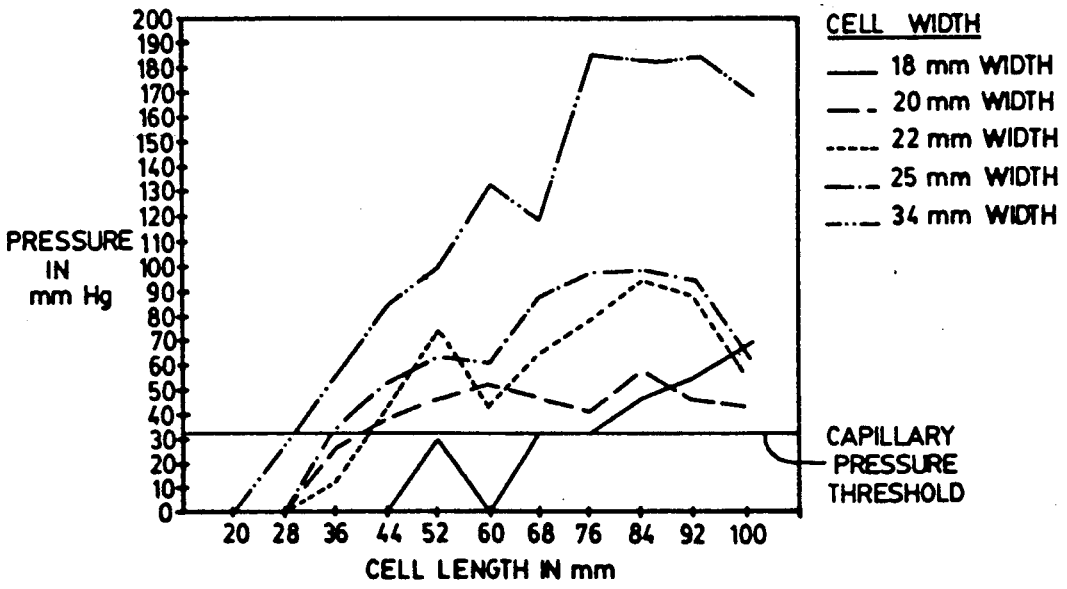
FIG. 6 is a graph of data obtained in Example II.

Using procedures similar to those described in Example I except that the holes were rectangular holes, a series of tests were conducted to determine the effect of cell geometry on the pressure exerted by ischial tuberosity. In all tests, the thickness of the sheet i.e. the excursion, was 8 mm. The holes were aligned in the anterior/posterior direction, and were of widths ranging from 18 to 34 mm and lengths of 20 to 100 mm. The results obtained are shown in FIG. 6. The capillary pressure threshold of 32 mm is also shown in that Figure!

EXAMPLE III

Figure 7:
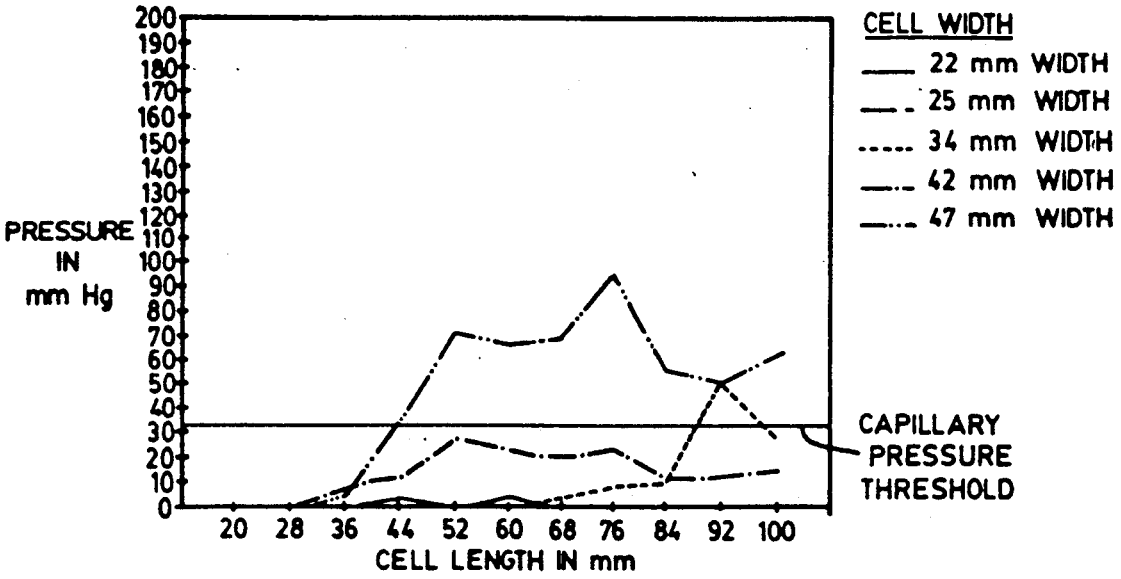
FIG. 7 is a graph of data obtained in Example III.

Example II was repeated, using the holes aligned in the transverse direction. The results obtained are shown in FIG. 7.

It will be noted that the results of Example II show that where the long axis of the holes was aligned in the anterior/posterior direction, only short cell lengths of 20–36 mm at widths of 18–34 mm gave pressures of less than the capillary pressure threshold. In contrast, the results of Example III show that much longer cells could be tolerated.

EXAMPLE IV

The pressure exerted by a male lying in the supine position on a mattress of the type used in hospitals and on a synthetic fibre layer that was on the mattress was measured at a plurality of positions on both the mattress and the layer in order to illustrate the pressure profile of a patient.

Figure 8:
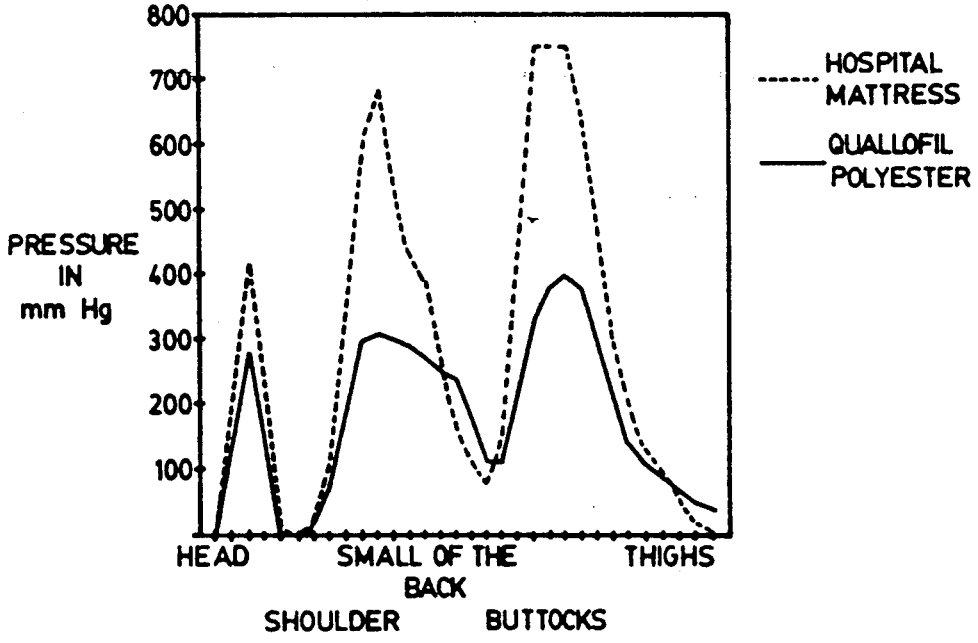
FIG. 8 is a graph of the pressure profile as measured in Example IV.

The results obtained are shown in FIG. 8. The three areas of high pressure exerted by the human were, in descending order, the buttocks, the shoulders and the head. The use of the synthetic fibre layer on the mattress resulted in a substantial reduction in the pressure exerted in the above three areas, that reduction being as high as about 60% in the area of the shoulders, but the pressure was still approximately an order of magnitude above the capillary threshold level in all three positions.

EXAMPLE V

The recovery to the normal (pretest) skin temperature of a person's buttocks following various period of time in a sitting position was monitored using a thermographic camera. The person was a healthy male aged 46, height 173 cm, weighing approximately 84 kg and of average build. The person sat on a soft cushion or a mattress system of the present invention operating on a cycle time of ten minutes for various periods of time, and then the time for his skin temperature to return to normal was monitored using an Agema Infra-red Thermographic camera, Model 870, with Image Analysis.

Figure 10:
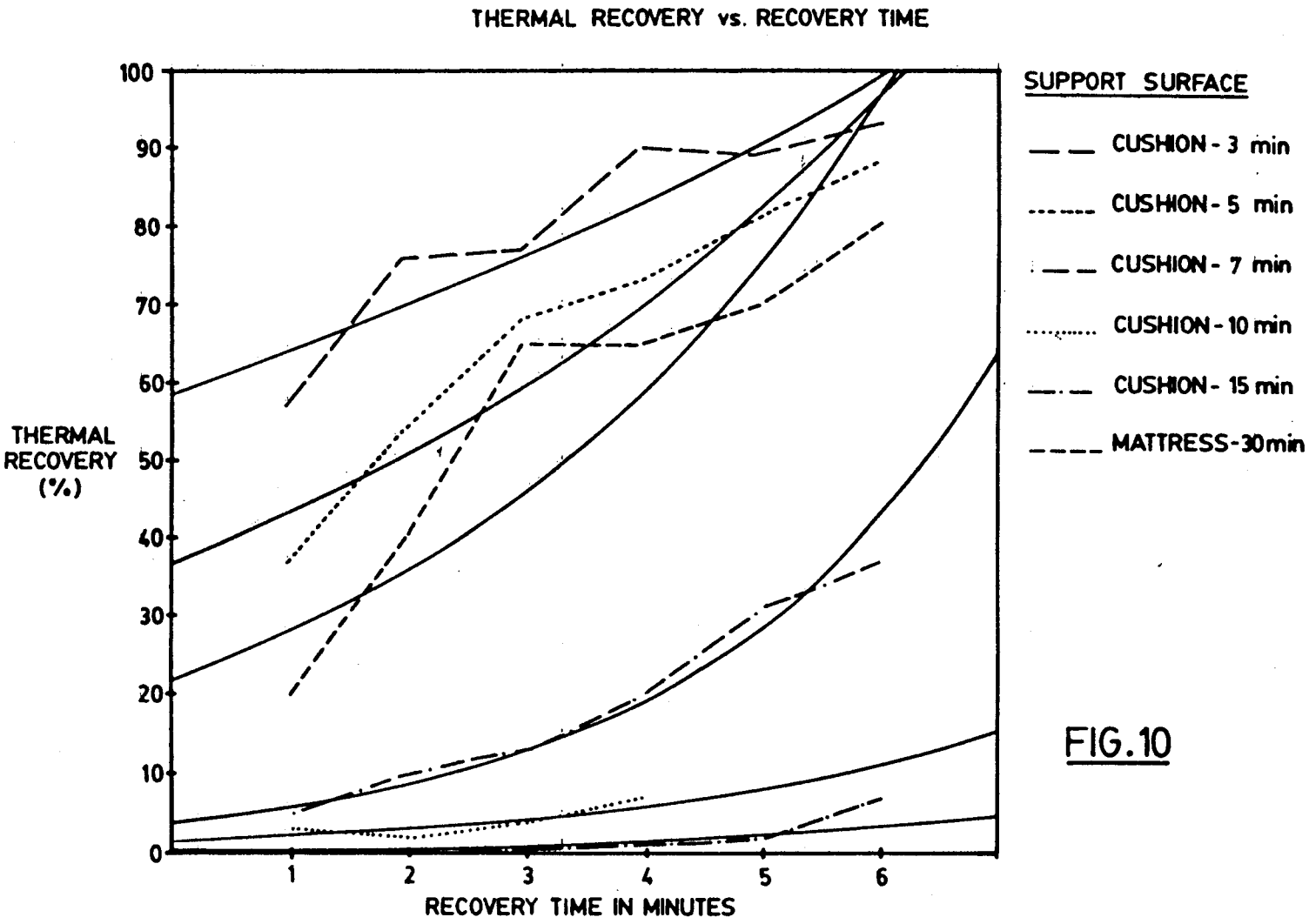
FIG. 10 is a graph of temperature versus recovery time as measured in Example V.

The results obtained are shown in FIG. 10. As skin temperature is directly proportional to blood flow in the skin, the recovery of skin temperature to normal values is an indicator of the state of blood circulation within the skin.

The results show that the recovery time increased exponentially with the length of the period of sitting. Moreover, the results show that recovery from sitting on a mattress system of the present invention for 30 minutes is almost as rapid as from sitting on the soft cushion for 5 minutes and significantly better than from sitting on the cushion for 7 minutes; it will be noted that the regression lines through the data for cushions at 3 and 5 minutes and for the mattress system of the invention tend to converge at about six minutes, whereas the regression lines for data with cushions at longer periods of time indicate a substantially longer period for recovery.

For optimal operation, the time of recovery to normal blood circulation in the pressure relief phase over deflated cells in a mattress system of the present invention should be matched with the pressure duration phase over inflated cells. The results show that a suitable cycle frequency of a mattress system of the present invention for use by the person described above in the sitting position would be approximately 10 minutes.

EXAMPLE VI

Figure 11:
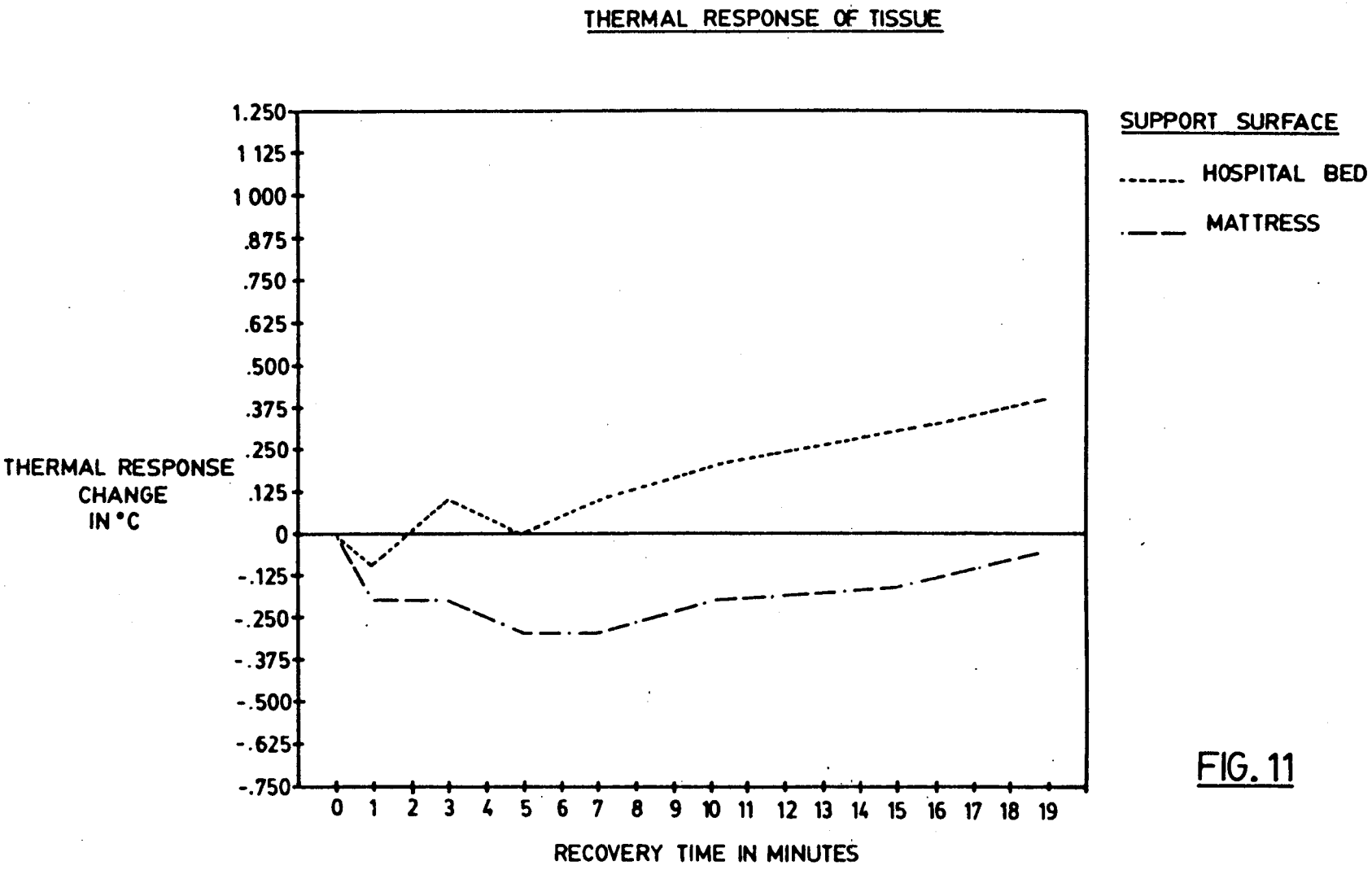
FIG. 11 is a graph of thermal response of tissue versus time as measured in Example VI.

The recovery of skin temperature of a person's sacral region following two hours in the supine position was monitored with infra red thermography. The person was a healthy male aged 46, height 173 cm, weight approximately 84 kg and of average build. The person was placed in the supine position on a standard hospital bed or on a mattress system of the present invention operating on a ten minute cycle time. Following a period of two hours on the bed or mattress, the person was repositioned on his right side for immediate monitoring of the sacral region using the thermographic camera of Example V. The average temperature change with time relative to control temperature for the person was measured. The results obtained are shown in FIG. 11.

The thermal response following the two hour period on the hospital bed indicates an erythema paratrimma, as shown by the persistent elevation in temperature relative to the control. Erythema paratrimma is characterized by an immediate skin reddening and temperature elevation following a period of stasis over a pressure point. In contrast, following the two hour period on the mattress system of the present invention, the thermal response approached normal temperature after 15 minutes without inducing erythema paratrimma.

We claim:

1. A support system comprising: a plurality of separate cells of selected size of shape in a monolayer, said cells being formed from flexible material; said material being sufficiently impermeable to a fluid contained in said cells so that each cell may be alternately (with respect to the adjacent cell) and repeatedly inflated and deflated; said cells being of such size and shape and having such intercellular spacing so that, in at least one of the width and length of said support system, the distance between centres of adjacent inflated cells (including the distance across a deflated cell) is less than approximately 25 millimeters; and said support system is capable of supporting a human body without bottoming out either of or between said inflated cells.

2. The support system of claim 1 in which, when the support system is supporting a human body, a deflated cell exerts a pressure of less than the human internal capillary threshold on the body.

3. The support system of claim 1 in which said cells are of a shape and size such that a weight of 2.5 kg and having a spherical surface with a diameter of 2.67 cm placed on the support system will not cause bottoming out of the support system.

4. The support system of claim 1 in which cells are capable of being inflated and deflated independently.

5. The support system of claim 1 in which the fluid is a fluorocarbon or a mixture of fluorocarbons.

6. The support system of claim 1 in which the fluid is an environmentally acceptable replacement for a fluorocarbon.

7. A support system comprising:

(a) a system comprising: a plurality of separate cells of selected size and shape in a monolayer, said cells being formed from flexible material; said material being sufficiently impermeable to a fluid contained in said cells so that each cell may be alternately (with respect to the adjacent cell) and repeatedly inflated and deflated; said cells being of such size and shape and having such intercellular spacing so that, in at least one of the width and length of said system, the distance between centres of adjacent inflated cells (including the distance across a deflated cell) is less than approximately 25 millimeters; and said system is capable of supporting a human body without bottoming out either of or between said inflated cells; and (b) means to inflate and deflate the cells, said means having a cycle time that promotes restoration of normal microcirculation of human skin while the cells are deflated.

8. The support system of claim 7 in which, when the system is supporting a human body, a deflated cell exerts a pressure of less than the human internal capillary threshold on the body.

9. The support system of claim 7 in which said cells are of a shape and size such that a weight of 2.5 kg and having a spherical surface with a diameter of 2.67 cm placed on the system will not cause bottoming out of the system.

10. The support system of claim 7 in which cells are capable of being inflated and deflated independently.

11. The support system of claim 7 in which the fluid is a liquid that is capable of being vaporized to inflate the cells.

12. The support system of claim 11 in which the means to inflate and deflate the cells is heating and cooling means.

13. The support system of claim 7 in which the fluid is a gas.

14. The support system of claim 7 in which the fluid is a liquid.

15. The support system of claim 13 in which the means to inflate the cells is a compressor.

16. The support system of claim 14 in which the means to inflate and deflate the cells is hydraulic means.

17. The support system of claim 12 including electrical heating means or thermoelectric means and in which the liquid is adapted to be vaporized by means of such electrical heating means or thermoelectric means.

18. The support system of claim 7 in which each cell is of a geometry that precludes complete collapse of the cell when deflated.

19. The support system of claim 18 in which the means to inflate the cells is controlled so that when one cell is inflated, an adjacent cell is deflated.

20. The support system of claim 14 in which the liquid is adapted to be both heated and cooled.

21. The support system of claim 14 in which the liquid is adapted to be either heated or cooled.

22. The support system of claim 7 in which the cells are adapted to be inflated and deflacted over a cycle time of less than two hours.

23. The support system of claim 7 in which the distance between adjacent inflated cells is less than 30 mm.

24. The support system of claim 7 in which the cells are inflated and deflated using a simulated wave motion over the support system.

25. The support system of claim 7 in which the cells are inflated and deflated using a simulated peristaltic motion over the support system.

26. A support system comprising, in sequence, (a) a system comprising a plurality of separate cells of selected size and shape in a monolayer, said cells being formed from flexible material; said material being sufficiently impermeable to a fluid contained in said cells so that each cell may be alternately (with respect to the adjacent cell) and repeatedly inflated and deflated; said cells being of such size and shape and having such intercullular spacing so that, in at least one of the width and length of said system, the distance between centres of adjacent inflated cells (including the distance across a deflated cell) is less than approximately 25 millimeters and said system is capable of supporting a human body without bottoming out either of or between said inflated cells;

(b) means to inflate and deflate the cells, said means having a cycle time that promotes restoration of normal microcirculation of human skin while the cells are deflated, (c) a layer of cushioning material; and (d) a layer of material having a high coefficient of friction.

27. The support system of claim 26 in which, when the system is supporting a human body, a deflated cell exerts a pressure of less than the human internal capillary threshold on the body.

28. The support system of claim 26 in which said cells are of a shape and size such that a weight of 2.5 kg and having a spherical surface with a diameter of 2.67 cm placed on the system will not cause bottoming out of the clinical support system.

29. The support system of claim 26 in which a fabric layer is located above the layer of flexible material, said fabric layer being between a moisture absorption layer and the layer of flexible material.

30. The support system of claim 29 in which the fabric layer is a removable fabric layer.

31. The support system of claim 29 in which the moisture absorption layer is a microporous film layer.

32. The support system of claim 29 in which the moisture absorption layer is a disposable layer.

33. The support system of claim 26 in which the fluid is a fluorocarbon or a mixture of fluorocarbons.

34. The support system of claim 26 in which the fluid is an environmentally acceptable replacement for a fluorocarbon.

35. The support system of claim 26 in which the fluid is a gas.

36. The support system of claim 26 in which the fluid is a liquid.

* * * * *